United States Patent [19]

Rosas

[11] 4,209,106

[45] Jun. 24, 1980

[54] CUP TOP REFLECTOR

[76] Inventor: Alan Rosas, 1650 Alexander SE., East Grand Rapids, Mich. 49506

[21] Appl. No.: 47,041

[22] Filed: Jun. 11, 1979

[51] Int. Cl.[2] ..... B65D 41/56; B65D 51/28; B65D 51/24

[52] U.S. Cl. ..... 220/212; 220/85 R; 116/28 R

[58] Field of Search ..... 220/85 R, 212, 200; 116/28 R, 202; 229/43, 1.5 B

[56] References Cited

U.S. PATENT DOCUMENTS

| | | | |
|---|---|---|---|
| 3,850,341 | 11/1974 | Bart | 220/212 |
| 4,040,549 | 8/1977 | sadler | 220/212 X |

*Primary Examiner*—George T. Hall

*Attorney, Agent, or Firm*—Price, Heneveld, Huizenga & Cooper

[57] ABSTRACT

The specification discloses a cup top cover having a reflectorized surface and means for securing the cover not only to the top of a cup, but also to a bicycle whereby waste of the normally disposed of cup top cover is minimized and safety is enhanced.

41 Claims, 3 Drawing Figures

CUP TOP REFLECTOR

BACKGROUND OF THE INVENTION

Of all of the issues facing society today, two of the more important appear to be (1) conservation of resources and (2) consumer safety. The present invention addresses both of these issues in a highly innovative way.

Fast food restaurants typically serve drinks in cardboard cups with plastic cup top covers. Both the cup and the cover are thrown away when the user is finished. The plastic of the cover is typically a petroleum product or at least incorporates petroleum products. Petroleum is, of course, an irreplaceable resource and accordingly, such waste constitutes a permanent loss. The present invention addresses itself to this problem.

For years, bicycle manufacturers have provided bicycles with reflectors so that bicyclers riding at twilight time or in the evening can be seen by motorists. However, as these reflectors become lost or broken, the cyclists often do not bother to replace them because of the cost of the plastic reflectors. As a result, a consumer safety hazard is created. The present invention addresses itself to this safety issue as well.

SUMMARY OF THE INVENTION

In the present invention, a product is provided which both enhances safety and minimizes waste. The cup top cover of the present invention includes a top with a reflectorized surface and means on the top for securing it snugly over the top of a cup as well as means on the top for securing it to a bicycle. Thus, when a consumer is through drinking his drink, he does not throw away the cup top cover of the present invention. Rather, he secures it to his bicycle and thus increases the usage and hence the value of the cup top cover and enhances his own safety.

These and other objects, advantages and features of the present invention will be more fully understood and appreciated by reference to the written specification and appended drawings.

DESCRIPTION OF THE PREFERRED EMBODIMENT

Figure 1:
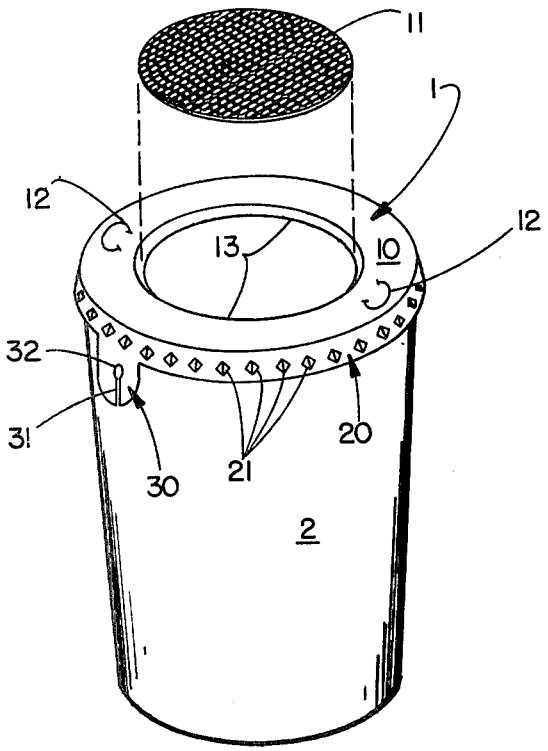
FIG. 1 is a perspective view of a cup and a cup top cover made in accordance with the present invention, with the reflectorized upper surface exploded away from the cup top cover.
Figure 2:
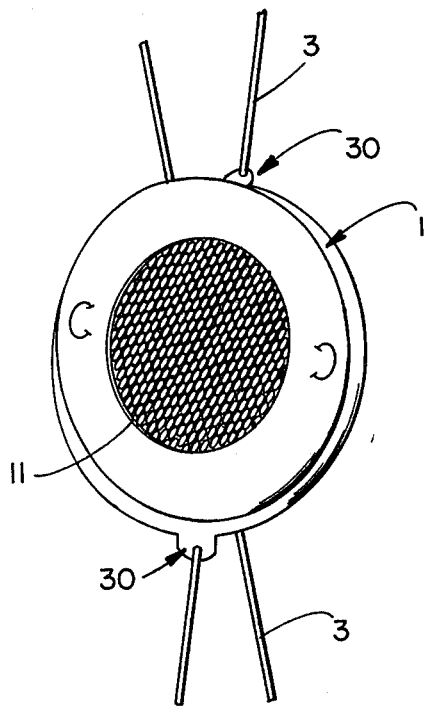
FIG. 2 is a perspective view of the cup top cover made in accordance with the present invention in position on the spoke of a bicycle wheel.
Figure 3:
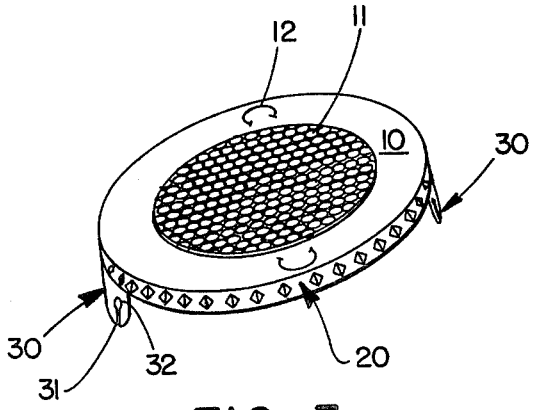
FIG. 3 is a perspective view of the cover alone.

The preferred embodiment cover 1 includes a top 10 having a reflector surface 11. A rim 20 depends downwardly from the top 10 for fitting snugly over the top rim of a cup 2. Also depending downwardly from top 10, or more specifically from rim 20, are a pair of oppositely disposed tabs 30 having slots 31 for snapping onto the spokes 3 of a bicycle wheel.

Cover 1 is molded of a plastic material and can be relatively thin as are conventional cup top covers. A relatively inexpensive plastic is typically used. Currently, many cup top covers are made of a polystyrene material.

The reflectorized surface 11 can be applied to top 10 of cover 1 in several different ways. One is to provide an adhesive back reflector material such that the reflector material can simply be pressed against the top 10 and will be held in place. This is illustrated in FIG. 1. A second alternative would be to paint a reflectorized material onto 10. Finally, the reflectorized surface 11 could be intergrally molded with the rest of cover 1.

Preferably, particularly when the adhesive backed reflector material is employed, top 10 includes a depressed area 13 into which a similarly shaped reflector material 11 can be located. Top 10 also includes at least one straw die cut 12 and in the case of the preferred embodiment shown in FIG. 1, includes two. Each die cut 12 allows the user to push a straw through top 10.

Rim 20, which depends downwardly from top 10, is integrally molded therewith. It includes a plurality of regularly spaced inwardly protruding shoulder projections 21. These snap under the rolled lip which is typically used on the top of a cup such as cup 2. These assist rim 20 in securely holding cover 1 to cup 2.

Tabs 30, which depend downwardly from the bottom edge of rim 20 on opposite sides thereof, are also integrally molded with cover 1. Preferably, tabs 31 are somewhat thicker than the thickness of typical plastic cup top covers. Thus, it is preferable that tabs 30 are somewhat thicker than rim 20 or top 10. This helps to insure that tabs 30 will not readily tear or break.

Tabs 30 are slotted at slot 31, which extends from the bottom of the tab about three quarters of the distance towards the top of the tab. Preferably, slot 31 terminates in an enlarged opening or slot head 32. The enlarged slot head opening fits over a bicycle spoke 3 and allows the edges of tabs 30 to snap back towards on another and close slot 31 around spoke 3 once spoke 3 is in place within opening 32.

Thus, for only a very modest investment, a fast food chain can change its throw away cup top covers from an article which permanently wastes our natural resources to an article which actually enhances the safety of its customers. When finished with his drink, the customer removes cup top cover 1 from cup 2 and snaps it into place on a spoke 3 of his bicycle.

Of course, it is understood that the above is merely a preferred embodiment of the invention and that various changes and alternations can be made without departing from the spirit and broader aspects of the invention as set forth in the appended claims.

The embodiments of the invention in which an exclusive property or privilege is claimed are defined as follows:

1. A cup top cover comprising:

a top having a reflectorized surface;

means on said top for securing said top snugly over the top of a cup; and means on said top for securing said top to a bicycle.

2. The cup top cover of claim 1 wherein said reflectorized surface is located on the upper surface of said top; said cup securing means depending from the bottom surface of said top and said bicycle securing means being located below the bottom surface of said top.

3. The cup top cover of claim 2 wherein said cup securing means comprises a peripheral rim extending downwardly from said top.

4. The cup top cover of claim 3 wherein said rim includes inwardly projecting shoulder projections for snapping over the rim of a cup.

5. The cup top cover of claim 4 wherein said top includes a straw cut therein whereby one can push a straw through said top.

6. The cup top cover of claim 3, 4 or 5 wherein said bicycle securing means comprises a pair of oppositely spaced slots in said cup top cover for slipping over the spoke of a bicycle wheel.

7. The cup top cover of claim 6 wherein said slots are located in oppositely disposed tabs which depend downwardly from said rim.

8. The cup top cover of claim 7 wherein each said slot has an enlarged head opening to receive a spoke of a bicycle wheel.

9. The cup top cover of claim 6 which is made of plastic.

10. The cup top cover of claim 7 wherein said bicycle securing means comprises a pair of oppositely spaced slots in said cup top cover for slipping over the spoke of a bicycle wheel.

11. The cup top cover of claim 8 wherein said bicycle securing means comprises a pair of oppositely spaced slots in said cup top cover for slipping over the spoke of a bicycle wheel.

12. The cup top cover of claim 1 wherein said reflectorized upper surface comprises an adhesive backed reflector material which is adhered to said top.

13. The cup top cover of claim 12 wherein said top includes a recess in which said adhesive backed reflector material is located.

14. The cup top cover of claim 1 wherein said reflectorized surface comprises a reflectorized paint material painted on said top.

15. The cup top cover of claim 1 wherein said reflectorized surface is integrally molded with said cup top cover of a plastic material.

16. The cup top cover of claim 1, 2, 3, 4, 5, 12, 13, 14 or 15 which is made of plastic.

17. A cup top cover comprising:

a top having a reflectorized upper surface;

a rim depending downwardly from said top for fitting snugly over the rim of a cup; and a pair of tabs depending downwardly from said rim on generally opposite sides thereof, with a slot located in each of said tabs and opening towards the bottom of said tab whereby said tabs can be fitted over the spoke of a bicycle wheel.

18. The cup top cover of claim 17 wherein said rim includes inwardly projecting shoulder projections for snapping over the rim of a cup.

19. The cup top cover of claim 17 wherein said top includes a straw cut therein whereby one can push a straw through said top.

20. The cup top cover of claim 17 wherein each said slot has an enlarged head opening to receive a spoke of a bicycle wheel.

21. The cup top cover of claim 17 or 20 which is made of plastic.

22. The cup top cover of claim 17 or 20 wherein said reflectorized upper surface comprises an adhesive backed reflector material which is adhered to said top.

23. The cup top cover of claim 22 wherein said top includes a recess in which said adhesive backed reflector material is located.

24. The cup top cover of claim 17 or 20 wherein said reflectorized surface comprises a reflectorized paint material painted on said top.

25. The cup top cover of claim 17 or 20 wherein said reflectorized surface is integrally molded with said cup top cover of a plastic material.

26. A method for minimizing waste and enhancing safety by providing drink top covers with a reflectorized surface and means for securing said cover to a bicycle, in addition to means for securing said cup top cover snugly over the top of a cup.

27. The method of claim 26 which includes locating said reflectorized surface on the upper surface of the top of said cover and locating said cup securing means and said bicycle securing means on the opposite, lower surface of said top.

28. The method of claim 27 in which providing said cup securing means comprises providing a rim depending downwardly from said top.

29. The method of claim 28 which includes providing said rim with inwardly projecting shoulder projections for snapping over the rim of a cup.

30. The method of claim 29 which includes providing said top with a straw cut therein whereby one can push a straw through said top.

31. The method of claim 28, 29 or 30 in which providing said bicycle securing means comprises providing a pair of oppositely spaced slots in said cup top cover for slipping over the spoke of a bicycle wheel.

32. The method of claim 31 which includes providing oppositely disposed tabs which depend downwardly from said rim and locating said slots in said tabs.

33. The method of claim 32 wherein each said slot has an enlarged head opening to receive a spoke of a bicycle wheel.

34. The method of claim 31 which includes making said cup top cover of a plastic material.

35. The method of claim 32 which includes making said cup top cover of a plastic material.

36. The method of claim 33 which includes making said cup top cover of a plastic material.

37. The method of claim 26 wherein providing said reflectorized upper surface comprises providing an adhesive backed reflector material which is adhered to said top.

38. The method of claim 37 which includes providing said top with a recess receiving said adhesive backed reflector material.

39. The method of claim 26 wherein providing said reflectorized surface comprises painting a reflectorized paint material on said top.

40. The method of claim 26 wherein said reflectorized surface is integrally molded with said cup top cover of a plastic material.

41. The method of claim 26, 27, 28, 29, 30, 37, 38, 39 or 40 which includes making said cup top cover of a plastic material.

* * * * *